United States Patent [19]

Kramer

[11] Patent Number: 4,943,684

[45] Date of Patent: Jul. 24, 1990

[54] CERAMIC ARTICLE, PROCESS FOR IMPRINTING CERAMIC ARTICLES AND APPARATUS

[75] Inventor: Karl H. Kramer, South Bellmore, N.Y.

[73] Assignee: First Eastern Equities, Inc., Ontario, Canada

[21] Appl. No.: 391,669

[22] Filed: Aug. 8, 1989

Related U.S. Application Data

[63] Continuation of Ser. No. 175,648, Mar. 21, 1988, abandoned, which is a continuation of Ser. No. 25,701, Mar. 13, 1987, abandoned.

[51] Int. Cl.[5] ..... B65D 25/34; B41M 3/12

[52] U.S. Cl. ..... 428/34.4; 8/471; 427/287; 220/94 A; 428/195; 428/913; 428/914; 503/227

[58] Field of Search ..... 428/145, 200, 202, 207, 428/914, 913, 34.4; 8/471; 427/287; 101/40; 220/94 A; 503/227

[56] References Cited

U.S. PATENT DOCUMENTS

| | | | |
|---|---|---|---|
| 4,174,250 | 11/1979 | Durand | 8/471 |
| 4,250,831 | 2/1981 | McMillin et al. | 101/470 |
| 4,314,814 | 2/1982 | Deroode | 8/471 |
| 4,581,266 | 4/1986 | Magnotta | 428/200 |
| 4,681,034 | 7/1987 | Schulzen et al. | 101/21 |

FOREIGN PATENT DOCUMENTS

| | | | |
|---|---|---|---|
| 2642350 | 12/1983 | Fed. Rep. of Germany . | |
| 1444368 | 7/1976 | United Kingdom | 8/471 |
| 1463596 | 2/1977 | United Kingdom . | |

*Primary Examiner*—James Seidleck
*Attorney, Agent, or Firm*—Blum Kaplan

[57] ABSTRACT

A substantially cylindrical ceramic, glass or porcelain article having a polymeric coating that is substantive to a sublimable dye is provided. A process and apparatus for applying a sublimation heat transfer image to a substantially cylindrical surface while maintaining the substantially cylindrical surface in a fixed position is also provided.

8 Claims, 6 Drawing Sheets

CERAMIC ARTICLE, PROCESS FOR IMPRINTING CERAMIC ARTICLES AND APPARATUS

This is a continuation of application Ser. No. 175,648, filed Mar. 21, 1988, now abandoned, which is a continuation of Ser. No. 025,701, filed Mar. 13, 1987 , now abandoned.

BACKGROUND OF THE INVENTION

This invention relates generally to ceramic articles, processes for imprinting such articles and imprinting apparatus and, more particularly, to a ceramic article, process and apparatus for imprinting a ceramic article using a sublimation heat transfer technique.

Sublimation heat transfer techniques for imprinting metal, especially aluminum, articles and textiles are well known. In general, sublimation heat transfer techniques require use of a sublimable dye incorporated on or in a suitable carrier. The carrier is affixed to a substrate and heat is applied in order to cause the dye to sublime into the substrate. In some instances, it is necessary to apply pressure in addition to heat in order to effect the sublimation transfer.

A sublimable dye is a dye that passes directly from a solid state to a gaseous state under proper conditions of temperature and pressure. The use of such dyes are discussed, for example, in U.S. Pat. No. 4,201,821 issued to Fromson et al on May 6, 1980, which also gives formulas for a number of such dyes.

Fromson et al relates to a method for decorating anodized aluminum with a design or image by a sublimation heat transfer process. The anodized aluminum substrate is coated with a porous unsealed anodic oxide layer and then with a polymeric material that is substantive to a sublimable dye. The carrier containing the sublimable dye is contacted with the polymeric material and heated for a period of time sufficient to cause the dye to sublimate and condense in the oxide layer and the polymeric material. Although not specifically stated, Fromson et al presumes that the anodized aluminum substrate provides a flat surface. A similar process is discussed in U.S. Pat. No. 4,177,299 issued to Severus et al on Dec. 4, 1979 wherein it is disclosed that optimum results are obtained when the oxide layer has a thickness between about 5 and 25 $\mu$m.

U.S. Pat. Nos. 4,465,489 issued Aug. 14, 1984 and 4,591,360 issued May 27, 1986 both to Jenkins et al disclose a method of decorating curved metal containers by providing the containers with a coating that is receptive to a sublimable dye. The receptive coating is a non-linear, cross-linked polyester or non-linear, cross-linked thermosetting acrylic resin. Epoxy polyester, polyester, polyester epoxy, alkyd, alkyd-melamine, acrylic, acrylated and acrylated acrylic are cited as suitable coating materials. A suitable sublimable dye on a carrier such as paper is secured to the coating material using a water-soluble adhesive. Heat is applied and the sublimable dyestuff is transferred into the coating layer through the adhesive. Then the carrier is removed using water.

An apparatus and method for printing cans from heat transfer paper are disclosed in U.S. Pat. Nos. 4,250,831 issued on Feb. 17, 1981 and 4,323,601 issued on Apr. 6, 1982 both to McMillan et al. The cylindrical cans or members are continuously rolled along the apparatus and heat transfer sheet material is wrapped around the cylindrical member. Heat is provided to cause the image to be transferred from the sheet material to the cylindrical member and then the carrier is unwrapped from the member. This is not suitable for use with mugs as the mug handle prevents the cylindrical member from being rolled.

In contrast, a traditional ceramic glazing process is shown in U.S. Pat. No. 1,334,301 issued to Hasburg on Mar. 23, 1920. As disclosed in the Hasburg patent, ceramic ware is glazed with a glaze that will take a stain and auxiliary glaze metallic salts or bases mixed with a clay material are applied. The ceramic ware is burned to develop the color by fire. The burned colored portion of the ceramic ware is then reglazed with a clear secondary glaze that must be fired. Such a process has the disadvantages that it is extremely time consuming and suitable equipment such as kilns or lehrs must be available for heating the glaze at temperatures up to about 1000° F. for an extended period of time.

Alternatively, ceramic mugs can be imprinted using special screen printing equipment and ceramic ink. Each article must then be dried or cured using a tedious and time consuming process that does not permit the production of large quantities of articles in a short period of time. Furthermore, recent revisions to Federal Occupational Safety and Health Administration (OSHA) requirements regarding the composition and safety standards for printing inks have had a deterrent effect on use of this process to produce ceramic mugs. Finally, any deviation from the strictest standard of care in producing these products will prevent the image from being dishwasher safe.

In another prior art method, a special type of decal known as an electrocal decal is applied in a production line requiring use of a kiln or oven. Most quality ceramic mugs are imprinted by this method, but the method is most suitable for production of large quantities of mugs of a single design or graphic. The process of baking and cooling each item can take as long as a day, representing a limitation on the number of articles produced and even the simplest kiln is expensive and unwieldy. Moreover, such a process requires preselection of the image and makes the production of small number of mugs very costly.

Accordingly, it is desirable to provide a ceramic article, process for imprinting such articles and an imprinting apparatus that overcomes the aforenoted disadvantages of the prior art.

SUMMARY OF THE INVENTION

Generally speaking, in accordance with the invention, a substantially cylindrical ceramic, glass or porcelain article having a polymeric coating that is substantive to a sublimable dye is provided. A process and apparatus for applying a sublimation heat transfer image to a substantially cylindrical surface while maintaining the substantially cylindrical surface in a fixed position is also provided.

It is, therefore, an object of the invention to provide a ceramic article adapted to receive a sublimation heat transfer image.

It is another object of the invention to provide a ceramic article having a polymeric coating thereon which is substantive to sublimation heat transfer dyes.

It is still another object of the invention to provide a process for imprinting a ceramic article using sublimation heat transfer dyes.

It is a further object of the invention to provide an apparatus for imprinting a substantially cylindrical article by a sublimation heat transfer process.

It is a still further object of the invention to provide a ceramic article, process and apparatus for imprinting the article that permits use of sublimation heat transfer techniques.

It is still another object of the invention to provide a ceramic article adapted to be imprinted, process and apparatus for imprinting that can be accomplished in a short period of time.

Still other objects and advantages of the invention will in part be obvious and will in part be apparent from the specification.

The invention accordingly comprises the several steps and the relation of one or more of such steps with respect to each of the others, the apparatus embodying features of construction, combinations and arrangement of parts which are adapted to effect such steps, and the article which possesses the characteristics, properties and relation of elements, all as exemplified in the detailed disclosure hereinafter set forth, and the scope of the invention will be indicated in the claims.

DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

The present invention provides a ceramic article adapted to accept a heat transfer dye, a process for imprinting the article using sublimation heat transfer techniques and an apparatus for imprinting such a substantially cylindrical ceramic article with a sublimation heat transfer dye. Although the article discussed herein is referred to throughout as a "ceramic" article, it is to be understood that the present invention is applicable to articles formed not only of ceramic, but also of glass and porcelain.

The article of the invention can be any type of ceramic, glass or porcelain and is preferably substantially cylindrical. In a preferred embodiment, the article is a ceramic, glass or porcelain mug such as mug 10 of the type shown in FIGS. 1 and 9. The term "ceramic" as used herein is also intended to encompass glass and porcelain surfaces.

Mug 10 is coated at least on its outer surface with a polymeric coating that is receptive to sublimable heat transfer dyes. The coating or glaze must be able to permanently bond to a nonporous, non-synthetic material and should be non-toxic and able to withstand multiple cycles of dishwasher use.

One suitable glaze material is the Epi-Life Two Part System manufactured and sold by Camger Chemical Systems, Inc., Norfolk, Mass. The Epi-Life Two Part System consists of an epoxy resin and an epoxy resin hardener. To provide the mug glaze, two parts of the epoxy resin and one part of the hardener are thoroughly mixed and sprayed on the ceramic mug. The glazed mug is baked at a temperature of between about 325° and 375° F. for a period of between about 25 and 35 minutes. In a preferred embodiment, the glazed mug is baked at a temperature of about 350° F. for 30 minutes. Other resins that are suitable for use on ceramic mugs for the purpose of accepting a sublimation heat transfer image include Dion Cor-Res 6696T and Dion-Iso® 6631T, both of which are polyester resins manufactured and sold by Koppers Company, Inc., Pittsburgh, Pa.

The intended use of the Epi-Life Two Part System is as a coating for the interior walls of large food vats and containers. Accordingly, each of these resins are FDA approved for use in food contact applications and use of any of these resins to glaze ceramic mugs for eating and drinking is appropriate. Furthermore, these resins will adhere to ceramic, are dishwasher safe and most importantly, for purposes of the instant invention, will accept a sublimation heat transfer image.

Sublimation heat transfer materials wherein a sublimable dye is encapsulated in or on a suitable carrier such as a lacquer or nitrocellulose resin are well known. Such sublimable dye transfer vehicles are discussed, for example, in U.S. Pat. No. 4,201,821, which patent is incorporated by reference as if fully set forth herein. The only limitation on such transfers for purposes of the present invention is that the transfer must be uncoated.

Figure 2:
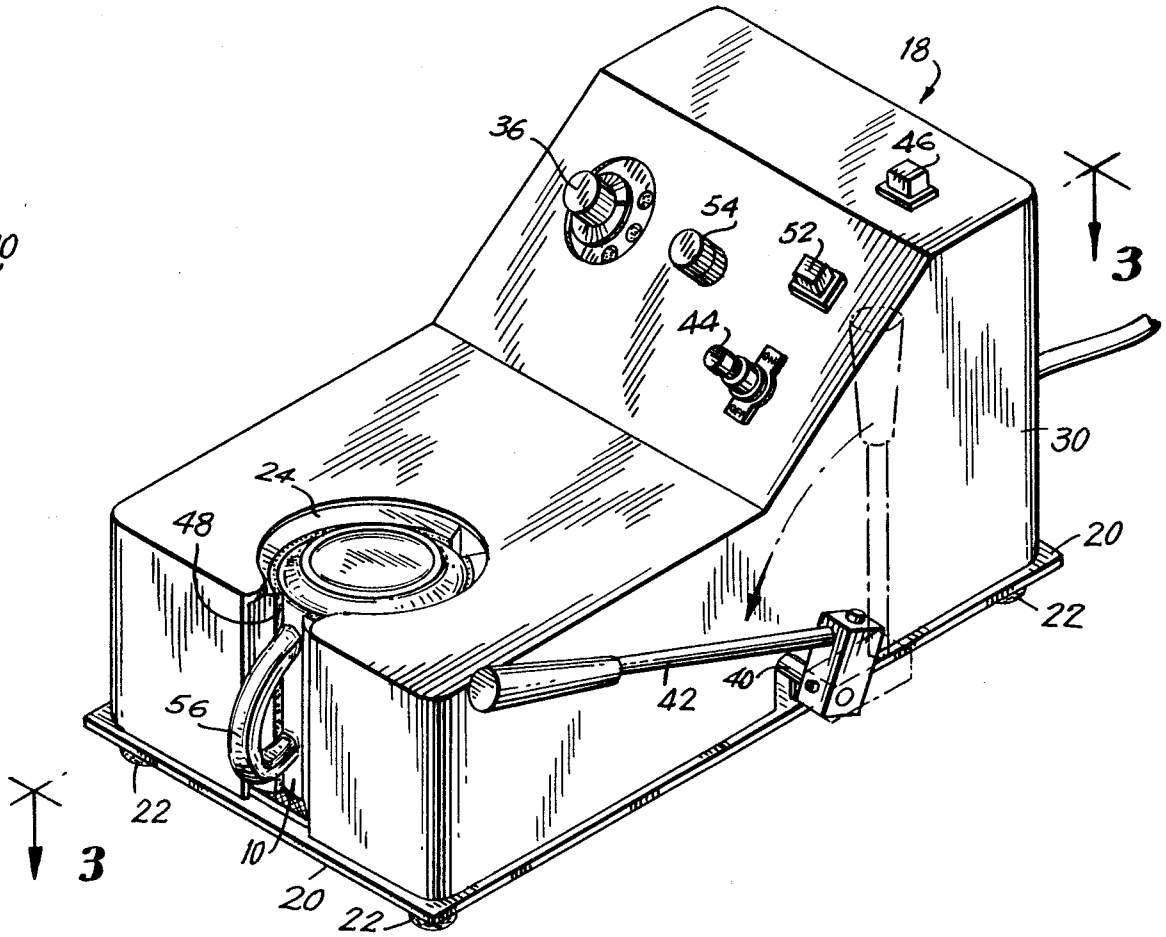
FIG. 2 is a perspective view of an apparatus constructed and arranged in accordance with the invention in an operative mode with an appropriately positioned article.
Figure 1:
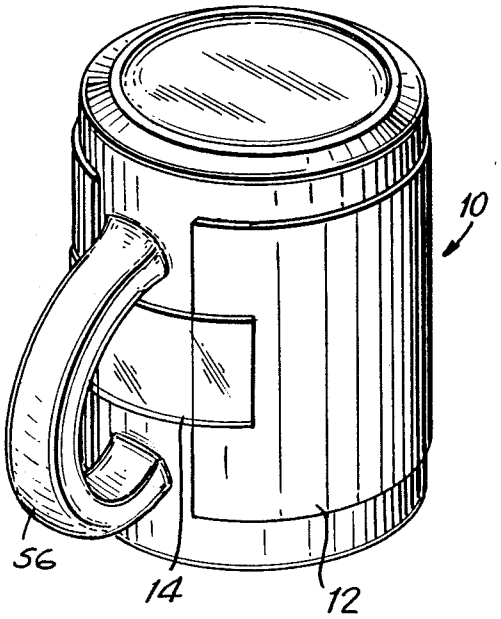
FIG. 1 is a perspective view of an article constructed and arranged in accordance with the invention shown upside down with a decal affixed thereto.
Figure 3:
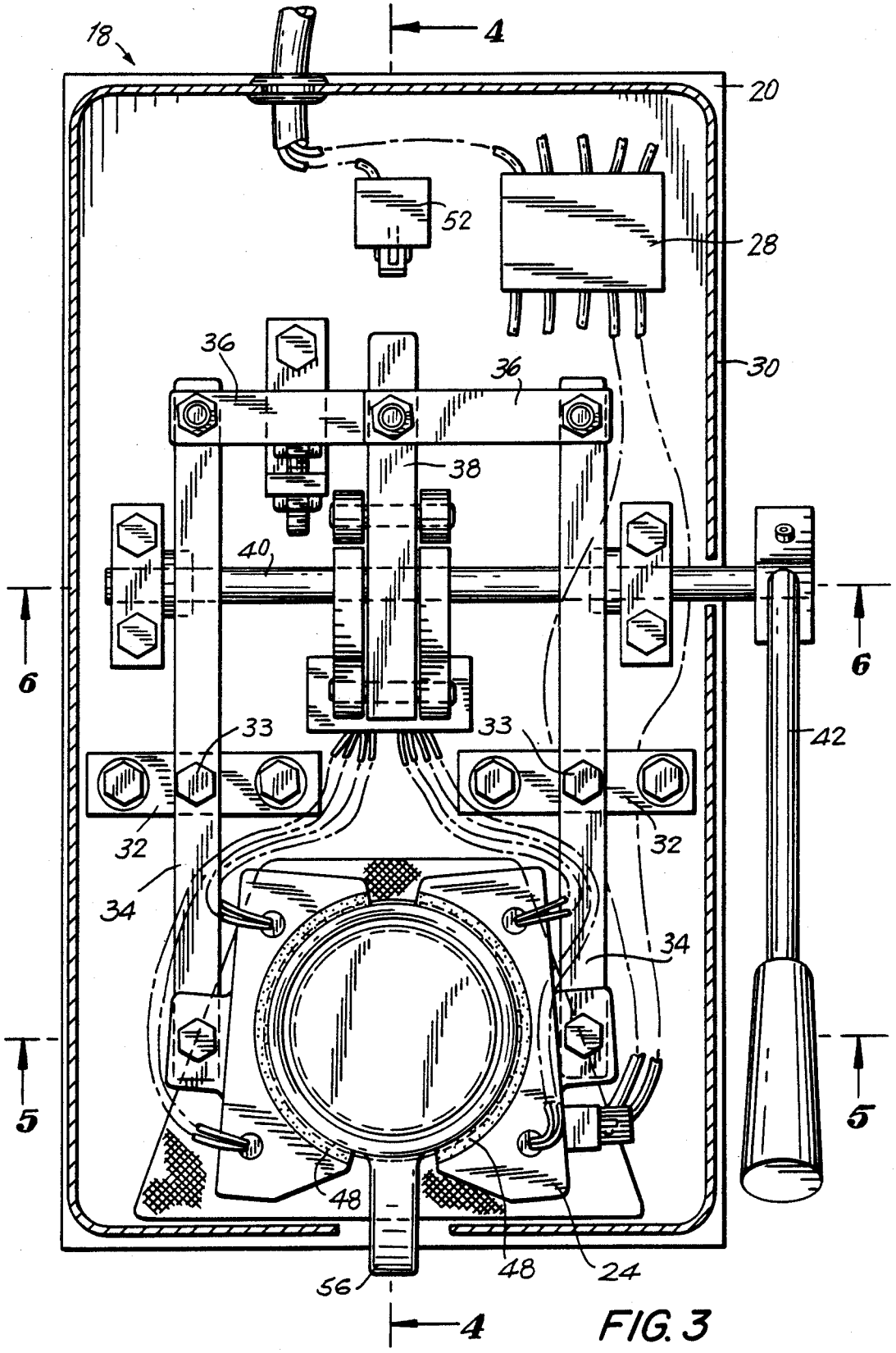
FIG. 3 is a cross-sectional view of the apparatus of FIG. 2 taken along lines 3—3.
Figure 4:
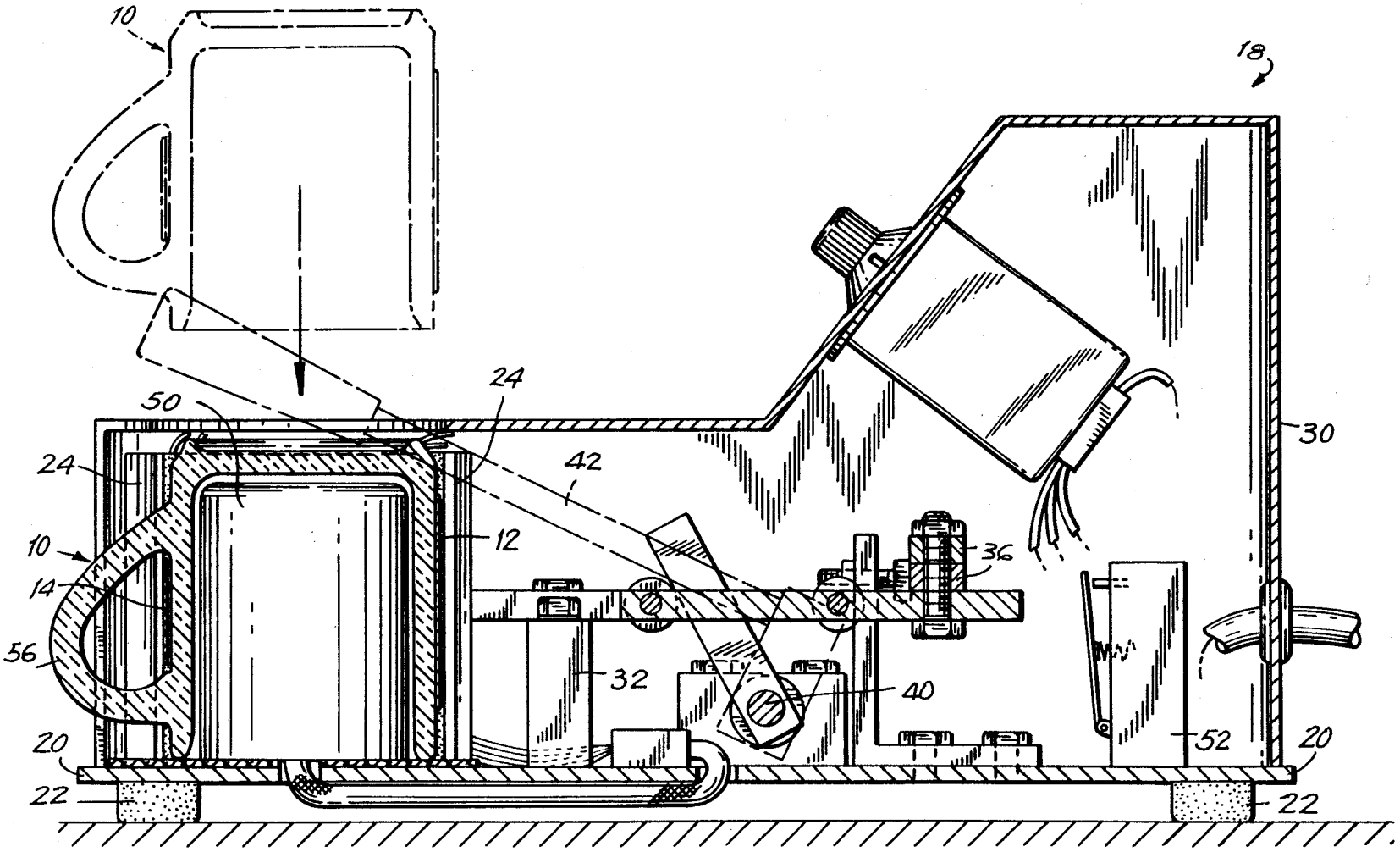
FIG. 4 is a cross-sectional view of the apparatus of FIGS. 2 and 3 taken along lines 4—4 of FIG. 3.
Figure 5:
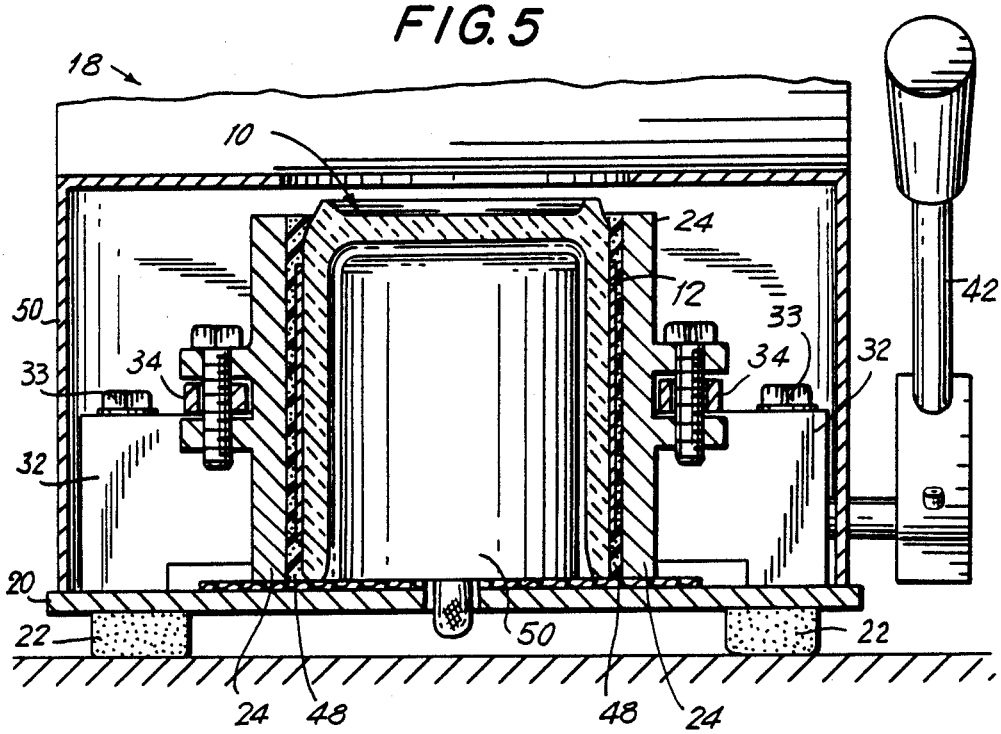
FIG. 5 is a cross-sectional view of the apparatus of FIGS. 2, 3 and 4 taken along lines 5—5 of FIG. 3.
Figure 6:
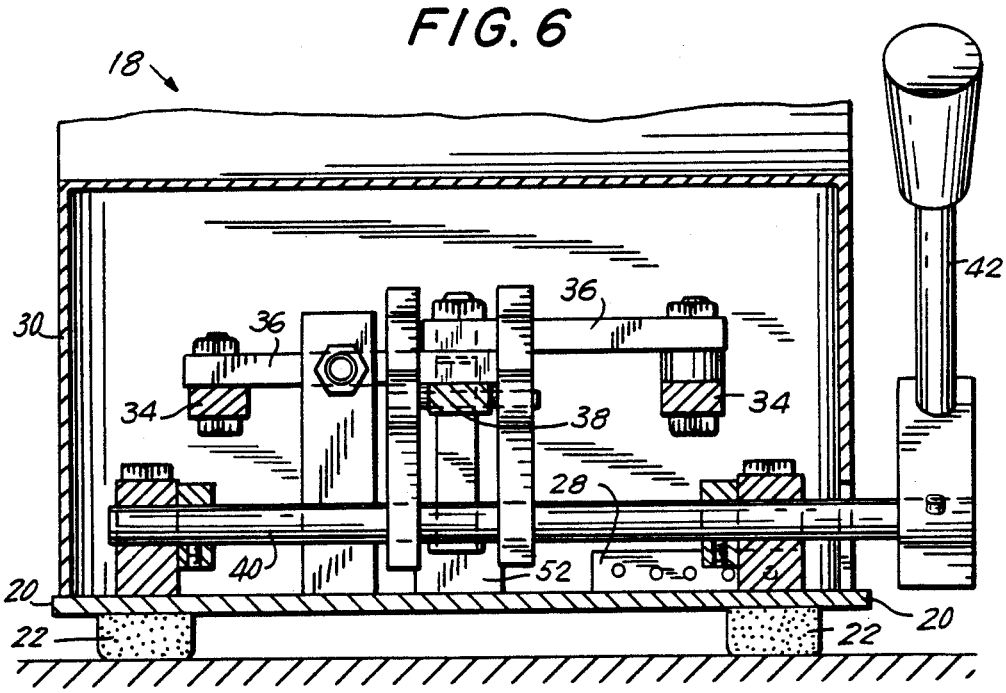
FIG. 6 is a cross-sectional view of the apparatus of FIGS. 2, 3, 4 and 5 taken along lines 6—6 of FIG. 3.
Figure 7:
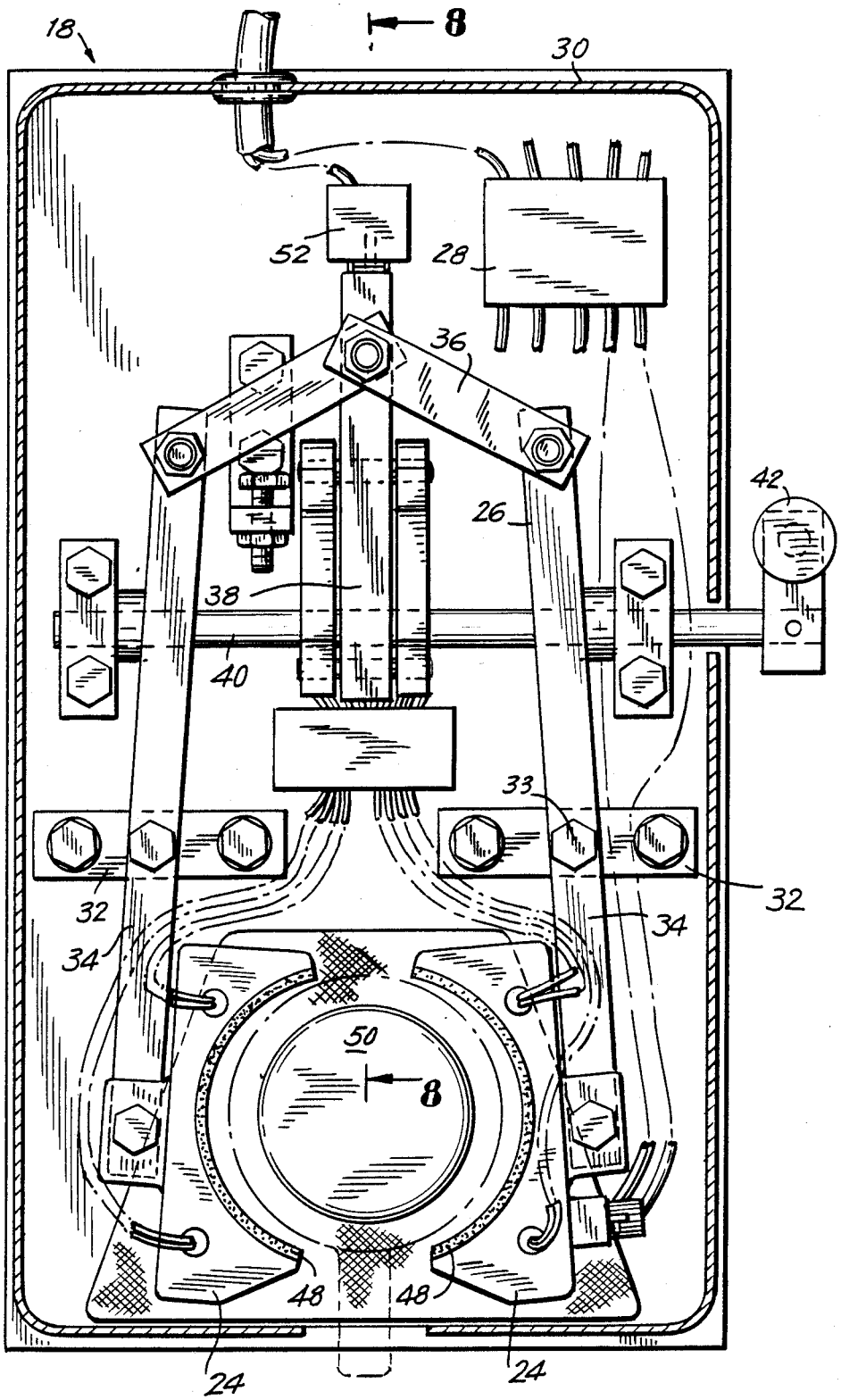
FIG. 7 is a plan view of an apparatus constructed and arranged in accordance with the invention shown in an inoperative mode with the cover removed.
Figure 8:
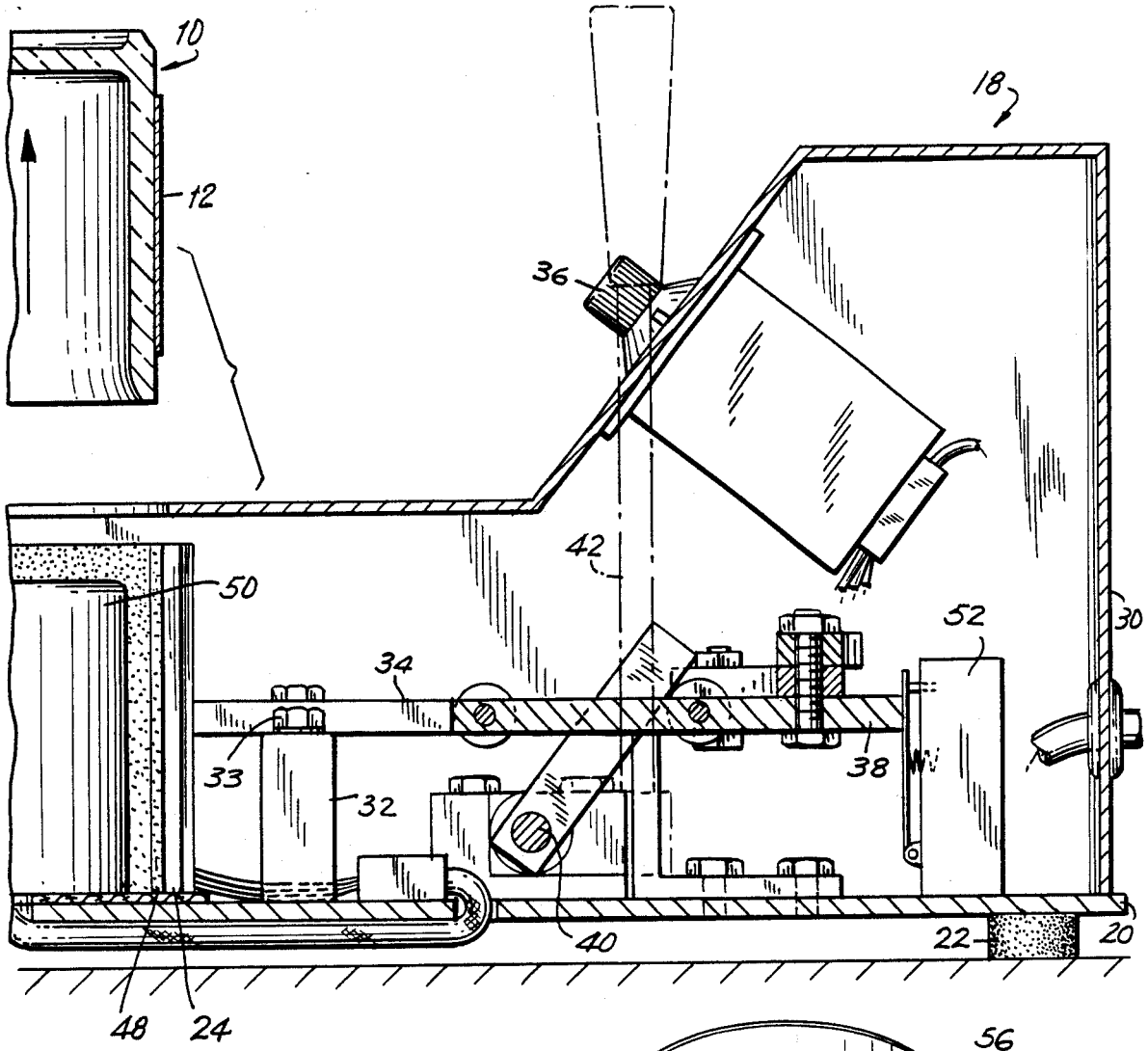
FIG. 8 is a cross-sectional view of the apparatus taken along lines 8—8 of FIG. 7.

To effect a sublimation heat transfer onto a glazed ceramic article, a heat transfer carrier 12 having a suitable sublimable dye impregnated therein or thereon is taped onto a glazed ceramic mug using heat resistant tape 14 in the manner depicted in FIG. 1. The transfer vehicle 14 is taped so that the sublimable dye is in direct contact with the glazed coating on mug 10.

Heat and pressure is applied to cause the sublimable dyes in heat transfer carrier 12 to be transferred directly into the glazed coating of mug 10. In the case of providing a transfer onto a glazed ceramic mug, heat is applied at a temperature between about 375° and 400° F. for a period of between about 60 seconds and 2½ minutes.

Figure 9:
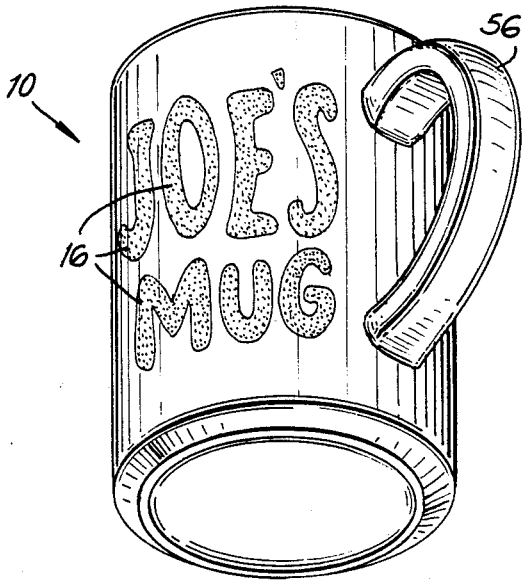
FIG. 9 is a perspective view of an article having a sublimation heat transfer image printed thereon.

During the period when heat and/or pressure are being applied, the dyes from heat transfer carrier 12 sublime from the carrier into the glazed coating on mug 10. At the end of the 60 second to 2½ minute period, the transfer is untaped and a heat transfer image 16 remains on mug 10 as shown in FIG. 9. No overglaze, drying or cleaning is required.

An apparatus adapted to apply heat and pressure to the back of heat-resistant carrier 12 taped to a glazed article 10 is shown in FIGS. 2 through 8. Imprinting apparatus 18 comprises a base 20 having feet 22. Upright shoulders 32 are supported on base 20, and pivot arms 34 are pivotally supported on shoulders 32 by pivot pins 33. At one end of pivot arm 34 is a platen 24.

Each platen 24 is movable between a first open position wherein it is adapted to accept a mug 10 for imprinting and a second closed position in engagement with the surface of the mug for imprinting an image thereon.

Each movable platen 24 has a curved surface and individual pad 48 thereon at the surface opposite the connection to pivot arms 34. A substantially cylindrical center core 50 unconnected to the platens is also provided on base 20, and is located between the curved surfaces of platens 24.

Each pivot arms 34 is pivotably connected at their opposite end to a first end of pull arm 36. The opposite end of each pull arm 36 is connected to a first end of drive arm 38. The opposite end of drive arm 38 is connected to drive shaft 40. Drive shaft 40 is connected to external lever 42. Accordingly, platens 24 are displaced between a first open position and a second closed position for applying heat and pressure to mug 10 by displacement of lever 42.

A transformer 28 is supported on base 20 and is connected through leads to each movable platen 24. Transformer 28 is also adapted to be coupled to an external power source. Switch 52 is supported on base 20 and is electrically coupled to the transformer circuit for the purpose of turning transformer 28 on and off.

Cover 30 is supported on base 20 along the periphery thereof and has timer means 36, control switch 44, power light 46, thermostat light 52 and fuse 54 supported thereon.

In use, transformer 28 is coupled to an external power source and control switch 44 is switched to an "on" position. Both power light 46 and thermostat light 52 are lit. When thermostat light 52 goes off, the machine 18 is ready for use. To use machine 18, lever arm 42 is moved downward so that movable platens 24 are displaced into a first open position. In this position, drive arm 38 is not in contact with switch 52 so that the transformer circuit remains open and no heat is applied to platens 34.

A glazed ceramic mug 10 having a heat transfer carrier 12 affixed thereto by heat resistant tape 14 is placed over center core 50 with handle 56 extending outward of imprinting apparatus 18. External lever 42 is moved upward so that movable platens 24 move together in such a way that pad material 48 contacts the back of heat transfer carrier 12 and mug 10 in a substantially uniform manner so as to provide consistent pressure around the substantially cylindrical surface of mug 10.

When external lever 42 is moved to the upward position, drive arm 38 moves towards switch 52 and closes the transformer circuit. This allows the platens 24 to be heated and timer means 36 to reset itself so as to sound an alarm after a predetermined period of time.

When the alarm signal rings, external lever 42 is moved downward to displace the platens from a closed position to an open position. Mug 10 having a sublimation heat transfer pattern printed thereon is removed from imprinting apparatus 18 and heat transfer carrier 12 is removed from mug 10.

It will thus be seen that the objects set forth above, among those made apparent from the preceding description, are efficiently attained and, since certain changes may be made in carrying out the above process, in the described product, and in the construction(s) set forth without departing from the spirit and scope of the invention, it is intended that all matter contained in the above description and shown in the accompanying drawing(s) shall be interpreted as illustrative and not in a limiting sense.

It is is also to be understood that the following claims are intended to cover all of the generic and specific features of the invention herein described and all statements of the scope of the invention which, as a matter of language, might be said to fall therebetween.

What is claimed is:

1. A ceramic article having a substantially cylindrical shape and a protruding handle member, the article having at least one curved surface for receiving a sublimation heat transfer image, said curved surface being coated to a predetermined thickness with a polymeric coating, said coating being capable of permanently bonding with the ceramic article and being substantive to sublimation heat transfer dyes.

2. The ceramic article of claim 1, wherein the coating is an epoxy resin.

3. The ceramic article of claim 2, wherein the coating is a nontoxic glaze capable of withstanding repeated exposure to hot water and detergent.

4. The ceramic article of claim 1, wherein the coating is a polyester resin.

5. The ceramic article of claim 1, wherein the coating is approved by the FDA for food contact applications and capable of withstanding repeated exposure to hot water and detergent.

6. The ceramic article of claim 1, wherein the ceramic article is a glass article.

7. The ceramic article of claim 1, wherein the ceramic article is a porcelain article.

8. The ceramic article of claim 1, wherein the ceramic article is a mug.

* * * * *